US011217914B2

(12) United States Patent
Tsuchiya

(10) Patent No.: US 11,217,914 B2
(45) Date of Patent: Jan. 4, 2022

(54) GROUND TERMINAL

(71) Applicant: Sumitomo Wiring Systems, Ltd., Yokkaichi (JP)

(72) Inventor: Takahiro Tsuchiya, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/907,410

(22) Filed: Jun. 22, 2020

(65) Prior Publication Data

US 2020/0412033 A1 Dec. 31, 2020

(30) Foreign Application Priority Data

Jun. 26, 2019 (JP) ..... JP2019-118471

(51) Int. Cl.
*H01R 11/12* (2006.01)
*H01R 4/64* (2006.01)
*H01R 13/633* (2006.01)

(52) U.S. Cl.
CPC ..... *H01R 11/12* (2013.01); *H01R 4/64* (2013.01); *H01R 13/633* (2013.01); *H01R 2201/26* (2013.01)

(58) Field of Classification Search
None
See application file for complete search history.

(56) References Cited

U.S. PATENT DOCUMENTS 6,783,377 B2 * 8/2004 Aoyama ..... H01R 11/12 439/92
7,597,581 B2 * 10/2009 Trout ..... H01R 13/633 439/474
7,955,101 B2 * 6/2011 Lawson ..... H01R 11/12 439/177
10,236,595 B2 * 3/2019 Yamamoto ..... H01R 4/34
10,367,277 B2 * 7/2019 Lee ..... H01R 11/09

FOREIGN PATENT DOCUMENTS

JP 9-92360 4/1997

* cited by examiner

*Primary Examiner* — Felix O Figueroa
(74) *Attorney, Agent, or Firm* — Gerald E. Hespos; Michael J. Porco; Matthew T. Hespos

(57) ABSTRACT

It is aimed to make a ground terminal easily broken even if forces are applied to the ground terminal from various directions. A ground terminal (10) to be attached to a body (11) includes a body fixing portion (12) to be fixed to the body 11 and a wire connecting portion (14) to be connected to a wire (13). The body fixing portion (12) is plate-like and includes a through hole (19) through which a fixing member is inserted. The body fixing portion (12) is formed with an arc groove having an arc shape along a peripheral edge of the through hole (19). The body fixing portion (12) is formed with an oblique groove connected to the arc groove and extending to intersect an extending direction of the wire connected to the wire connecting portion (14).

18 Claims, 17 Drawing Sheets

GROUND TERMINAL

BACKGROUND

Field of the Invention

This disclosure relates to a ground terminal.

Related Art

Japanese Unexamined Patent Publication No. H09-92360 discloses a ground terminal to be attached to a body of a vehicle. This ground terminal includes a wire fixing portion, a body fixing portion and an easily breakable portion. If the wire fixing portion is pulled up after the ground terminal is attached to the body by a bolt passed through a bolt mounting hole, the wire fixing portion is separated from the body fixing portion while the easily breakable portion is broken. Thus, a wire is removed from the body.

The easily breakable portion of the above-described ground terminal is formed along a direction orthogonal to an extending direction of the ground wire in a boundary part between the body fixing portion and the wire fixing portion. In this way, if a force for pulling apart the ground terminal directly upward from the body is applied to the ground wire, the ground terminal can be bent along the easily breakable portion and smoothly broken.

However, the ground terminal is attached in various postures at various positions of the body. Thus, for example, if a force for pulling apart the ground terminal directly upward from the body is not applied to the ground terminal, there is a concern that the ground terminal is not bent smoothly along the easily breakable portion and cannot be broken.

This disclosure was completed on the basis of the above situation and aims to provide a ground terminal that is easily breakable even if forces in various directions are applied.

SUMMARY

This disclosure is directed to a ground terminal to be attached to a body, the ground terminal including a body fixing portion to be fixed to the body, and a wire connecting portion to be connected to a wire. The body fixing portion is plate-like and includes a through hole through which a fixing member is inserted. The body fixing portion is formed with an arc groove having an arc shape along a peripheral edge of the through hole. Additionally, the body fixing portion is formed with an oblique groove connected to the arc groove and extending to intersect an extending direction of the wire connected to the wire connecting portion.

If a force in a direction to pull the fixing member from the body is applied to the ground terminal via the wire, stress concentrates on the arc groove, a crack grows from the arc groove and the body fixing portion is broken. Further, if a force in a direction to rotate the body fixing portion about the fixing member is applied to the ground terminal via the wire, stress concentrates on the oblique groove extending to intersect the extending direction of the wire. Thus, a crack grows from one end part of the oblique groove and the body fixing portion is broken. In this way, the ground terminal can be broken easily even if forces are applied to the ground terminal from various directions.

The arc groove of one embodiment is formed in a region of the body fixing portion outside a part where the fixing member and the body fixing portion are in contact, with the body fixing portion fixed to the body by the fixing member.

The body fixing portion broken at the arc groove by receiving a force from the wire is divided into a part where the fixing member and the body are in contact and the region outside the part where the fixing member and the body fixing portion are in contact. In this way, the part outside the part where the fixing member and the body fixing portion are in contact easily is removed from the body.

The arc groove may be between the through hole and the wire connecting portion in the body fixing portion. Thus, a force received from the wire is not received by a part of the body fixing portion fixed to the body by the fixing member, but is transmitted to the arc groove. Therefore, the ground terminal is broken easily at the arc groove.

The oblique groove may be formed along a tangent to the arc groove. A crack grown along the oblique groove smoothly extends to the arc groove from a contact point. In this way, if a crack is formed in the oblique groove, this crack easily is caused to grow to the arc groove. Since the ground terminal is broken at the arc groove in this way, a part connected to the wire and the wire connecting portion and behind the arc groove easily is removed from the body.

The body fixing portion of certain embodiments has a recess where the arc groove and the oblique groove connect. The recess may have a triangular shape when viewed from a direction intersecting a plate surface of the body fixing portion. The body fixing portion is thinned vertically in the part having the recess so that the body fixing portion is broken easily.

The oblique groove may extend to a side edge of the body fixing portion. Thus, the breakage of the body fixing portion easily progresses from a part where the oblique groove reaches the side edge of the body fixing portion, and the ground terminal easily is divided.

An oblique groove notch cut toward the oblique groove from the side edge of the body fixing portion may be formed in a part of the side edge of the body fixing portion where the oblique groove reaches the side edge of the body fixing portion. Thus, the body fixing portion is broken easily from the oblique groove notch, and the ground terminal can be divided easily.

An arc groove notch cut toward the arc groove may be formed at a position corresponding to an end part of the arc groove on the side edge of the body fixing portion. When a force is applied to the wire, a crack formed in the arc groove grows to the end part of the arc groove and reaches the arc groove notch so that the body fixing portion is broken. In this way, the ground terminal can be divided easily.

A breaking hole may penetrate through the body fixing portion near the arc groove. If the wire receives a force to be pulled rearward, stress concentrates on the breaking hole and the body fixing portion starts to be broken from an edge of the breaking hole. Then, the crack reaches the arc groove formed near the breaking hole and the breakage of the body fixing portion progresses farther in the arc groove. In this way, the ground terminal can be divided easily if the wire receives a force to be pulled rearward.

The arc groove may be continuous with both ends of the breaking hole. A crack formed in the edge of the breaking hole quickly extends to the arc groove extending from the both ends of the breaking hole and the breakage of the body fixing portion progresses along the arc groove. In this way, the ground terminal can be divided easily.

The oblique groove may extend at an angle of $\pi/4$ radians or $-\pi/4$ radians with respect to the extending direction of the wire fixed to the wire connecting portion. If an external force in a direction to rotate the body fixing portion about the fixing member is applied, the oblique groove formed to extend at the angle of π/4 radians or −π/4 radians with respect to the extending direction of the wire fixed to the wire connecting portion is broken more easily due to stress concentration. In this way, the ground terminal can be divided easily even if forces in various directions are applied to the wire.

The body fixing portion may be formed with plural oblique grooves, and the plural oblique grooves intersect each other. Even if a crack grows along only one of the oblique grooves, the crack grows to other oblique groove(s) intersecting the oblique groove in which the crack was formed, and the breakage of the body fixing portion progresses along the oblique grooves. In this way, the ground terminal is broken easily.

The arc groove and the oblique groove may be formed in both front and back surfaces of the body fixing portion. Thus, the breakage of the body fixing portion progresses from the both front and back surfaces of the body fixing portion so that the ground terminal is broken easily.

A back surface oblique groove formed in the back surface of the body fixing portion may be formed at a position corresponding to a front surface oblique groove formed in the front surface of the body fixing portion. In this way, the body fixing portion is thinner as compared to the case where the oblique groove is formed only in one of the front and back surfaces of the body fixing portion. Thus, the ground terminal is broken more easily.

A reinforcing rib may stand up from the plate surface of the body fixing portion on a side edge of the body fixing portion in a region where the arc groove and the oblique groove are formed. By forming the arc groove and the oblique groove in the body fixing portion, the body fixing portion is broken easily. However, it is desired to avoid the breakage of the body fixing portion at a timing different from a timing of dismantling a vehicle due to vibration applied to the wire and the ground terminal during the travel of the vehicle. According to the present disclosure, the region where the arc groove and the oblique groove are formed is reinforced on the side edge of the body fixing portion by the reinforcing rib. Thus, the breakage of the ground terminal during the travel of the vehicle can be avoided.

A projection extending in a direction intersecting the plate surface of the body fixing portion may be formed on the side edge of the body fixing portion, and the projection may be inserted into an insertion hole formed in the body. By inserting the projection into the insertion hole of the body, the ground terminal can be positioned easily when fixing the ground terminal to the body. In this way, the efficiency of an operation of assembling the ground terminal with the body is improved.

According to this disclosure, the ground terminal can be broken easily even if forces are applied to the ground terminal from various directions.

DETAILED DESCRIPTION

Hereinafter, embodiments of the present disclosure are described. The invention is not limited to these illustrations and is intended to be represented by claims and include all changes in the scope of claims and in the meaning and scope of equivalents.

First Embodiment

A first embodiment of the present disclosure is described with reference to FIGS. 1 to 7. A ground terminal 10 according to this embodiment is attached to a body 11 of a vehicle. The body 11 is made of metal and conductive. In the following description, a direction indicated by an arrow Z is referred to as an upward direction, a direction indicated by an arrow Y is referred to as a forward direction and a direction indicated by an arrow X is referred to as a leftward direction. The ground terminal 10 is attached in an arbitrary posture to the body 11. The configuration of the ground terminal 10 according to the present disclosure is not limited by description on directions below.

[Ground Terminal 10]

Figure 1:
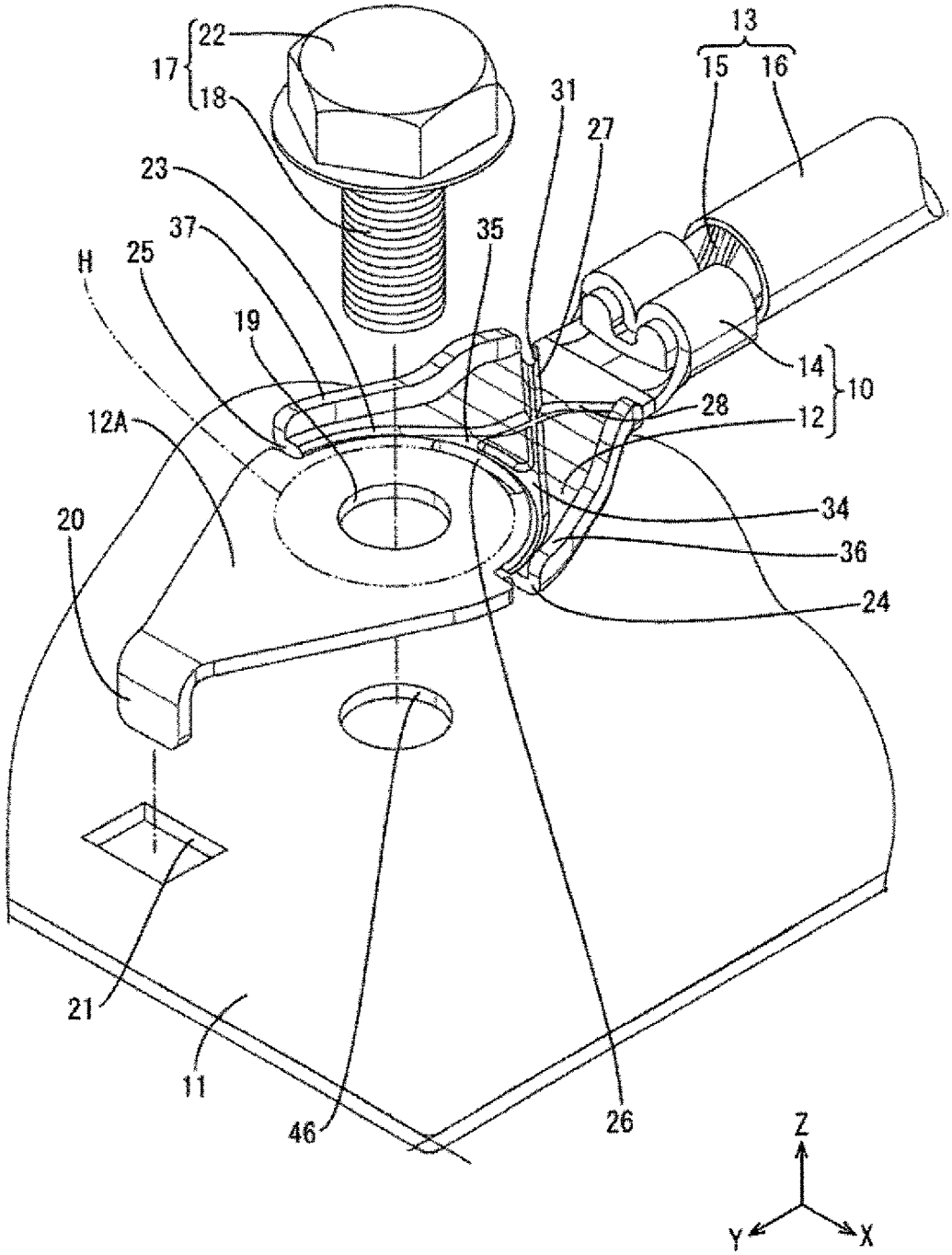
FIG. 1 is a perspective view showing a ground terminal according to a first embodiment.

The ground terminal 10 is formed by press-working a conductive metal plate. As shown in FIG. 1, the ground terminal 10 includes a body fixing portion 12 to be fixed to the body 11 and a wire connecting portion 14 to be connected to a wire 13.

[Wire Connecting Portion 14]

As shown in FIG. 1, the wire 13 includes a core 15 formed by stranding a plurality of metal thin wires and an insulation coating 16 covering the outer periphery of the core 15. A material for the core 15 can be selected from copper, copper alloy, aluminum, aluminum alloy and the like. The insulation coating 16 is made of insulating synthetic resin.

The insulation coating 16 is stripped on an end part of the wire 13 to expose the core 15. The wire connecting portion 14 is so crimped that a pair of metal pieces extending leftward and rightward are wound on the outer periphery of the core 15 exposed at the end part of the wire 13. In this way, the wire 13 and the ground terminal 10 are electrically connected. The wire connecting portion 14 according to this embodiment is a so-called wire barrel to be crimped to the core 15.

[Body Fixing Portion 12]

Figure 2:
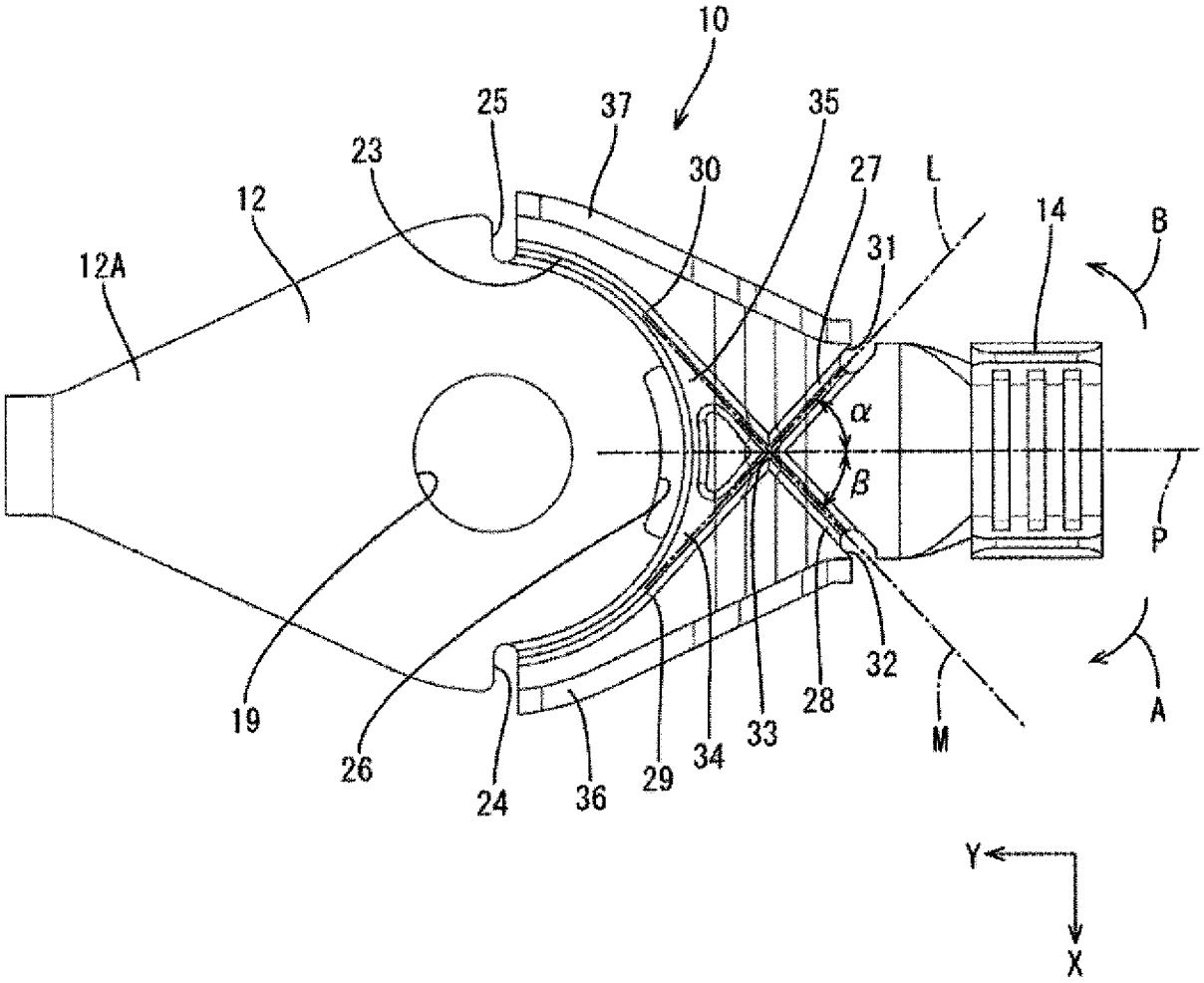
FIG. 2 is a plan view showing the ground terminal.

As shown in FIG. 1, the body fixing portion 12 is attached at a predetermined position of the body 11. The body fixing portion 12 is formed to extend forward (an example of an extending direction of the wire 13) from a front end part of the wire connecting portion 14. The body fixing portion 12 is formed into a shape flat in a vertical direction. A through hole 19 through which a shaft portion 18 of a bolt 17 (an example of a fixing member) is inserted is formed to penetrate through a front surface 12A (upper surface) and a back surface 12B (lower surface) of the body fixing portion 12. As shown in FIG. 2, the through hole 19 is provided coaxially with an axis P of the wire 13 connected to the wire connecting portion 14. In this embodiment, the axis P extends in a front-rear direction.

Figure 3:
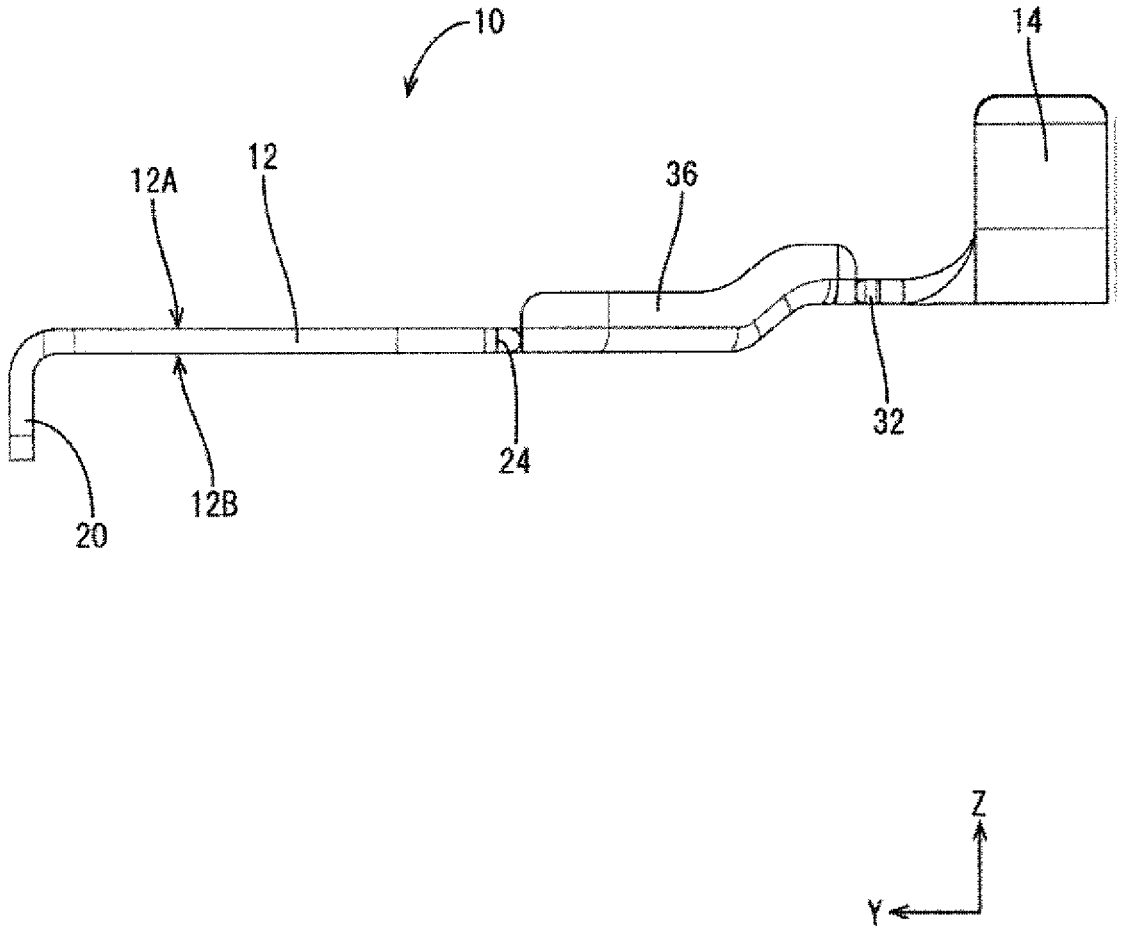
FIG. 3 is a side view showing the ground terminal.

A part of the body fixing portion 12 in front of the through hole 19 is tapered toward the front. As shown in FIG. 3, a projection 20 extending in a direction intersecting the plate surfaces of the body fixing portion 12 (downward) is formed on the front end edge of the body fixing portion 12. The projection 20 is provided coaxially with the axis P of the wire 13 connected to the wire connecting portion 14. The projection 20 has a rectangular shape when viewed from front.

An insertion hole 21 into which the projection 20 is inserted is open in the body 11. The insertion hole 21 is formed in a size capable of accommodating the projection 20. The insertion hole 21 may penetrate through the body 11 or may be a bottomed hole having a bottom part. A body through hole 46 through which the shaft portion 18 of the bolt 17 is inserted penetrates through the body 11. The shaft portion 18 of the bolt 17 inserted through the body through hole 46 is threadably engaged with an unillustrated nut.

With the nut threadably engaged with the shaft portion 18 of the bolt 17, the body fixing portion 12 is sandwiched between a head portion 22 of the bolt 17 and the body 11, whereby the body fixing portion 12 is fixed to the body 11. A region where the head portion 22 of the bolt 17 is in contact with the body fixing portion 12 is shown by two-dot chain line H in FIG. 1.

[Front Surface Arc Groove 23]

As shown in FIG. 1, on the front surface 12A of the body fixing portion 12, a front surface arc groove 23 (an example of an arc groove) having an arc shape along a peripheral edge of the through hole 19 is formed on a side outward of the region where the head portion 22 of the bolt 17 is in contact in a radial direction of the through hole 19. The head portion 22 of the bolt 17 and the front surface arc groove 23 are separated with the body fixing portion 12 fixed to the body 11 by the bolt 17.

As shown in FIG. 2, the front surface arc groove 23 is formed into a semicircular arc shape when viewed from above in a region between the through hole 19 and the wire connecting portion 14. First and second arc groove notches 24, 25 respectively cut toward the front surface arc groove 23 are formed at positions corresponding to left and right end parts of the front surface arc groove 23 on a side edge of the body fixing portion 12. The first and second arc groove notches 24, 25 are formed to penetrate through the body fixing portion 12. The left end part of the front surface arc groove 23 communicates with the first arc groove notch 24, and the right end part of the front surface arc groove 23 communicates with the second arc groove notch 25.

The body fixing portion 12 is formed with a breaking hole 26 penetrating through the body fixing portion 12 between the head portion 22 of the bolt 17 and the front surface arc groove 23 with the body fixing portion 12 fixed to the body 11 by the bolt 17. The breaking hole 26 is located outwardly of the bolt 17 in the radial direction of the through hole 19 with the body fixing portion 12 fixed to the body 11. The breaking hole 26 is formed into an arc shape along the peripheral edge of the through hole 19. The breaking hole 26 is formed to have a length, which is ⅙ of a circumference. As shown in FIG. 2, a rear hole edge of the breaking hole 26 is formed along a front edge part of the front surface arc groove 23.

[First and Second Front Surface Oblique Grooves 27, 28]

As shown in FIG. 2, a first front surface oblique groove 27 (examples of an oblique groove and a front surface oblique groove) obliquely extending to a right-rear side along a tangent to a first front surface contact point 29 somewhat behind the left end part of the front surface arc groove 23 and a second front surface oblique groove 28 (examples of the oblique groove and the front surface oblique groove) obliquely extending to a left-rear side along a tangent to a second front surface contact point 30 somewhat behind the right end part of the front surface arc groove 23 are formed in the front surface 12A of the body fixing portion 12.

As shown in FIG. 2, the first front surface oblique groove 27 extends to intersect the extending direction of the wire 13 (extending direction of the axis P) with the wire 13 connected to the wire connecting portion 14. An angle $\alpha$ formed between the axis P of the wire 13 and the first front surface oblique groove 27 is $\pi/4$ radians. That the angle $\alpha$ is $\pi/4$ radians includes a case where the angle $\alpha$ is $\pi/4$ radians and a case where the angle $\alpha$ can be substantially certified to be $\pi/4$ radians even if not being exactly $\pi/4$ radians.

The rear end edge of the first front surface oblique groove 27 reaches a right side edge of the body fixing portion 12. A first oblique groove notch 31 (an example of an oblique groove notch) cut along the first front surface oblique groove 27 from a part where the rear end edge of the first front surface oblique groove 27 reaches the side edge of the body fixing portion 12 is formed on the side edge of the body fixing portion 12. The first oblique groove notch 31 is formed to penetrate through the body fixing portion 12.

The second front surface oblique groove 28 extends to intersect the extending direction of the wire 13 (extending direction of the axis P) with the wire 13 connected to the wire connecting portion 14. An angle $\beta$ formed between the axis P of the wire 13 and the second front surface oblique groove 28 is $-\pi/4$ radians. That the angle $\beta$ is $-\pi/4$ radians includes a case where the angle $\beta$ is $-\pi/4$ radians and a case where the angle $\beta$ can be substantially certified to be $-\pi/4$ radians even if not being exactly $-\pi/4$ radians.

The rear end edge of the second front surface oblique groove 28 reaches a left edge of the body fixing portion 12. A second oblique groove notch 32 (an example of the oblique groove notch) cut along the second front surface oblique groove 28 from a part where the rear end edge of the second front surface oblique groove 28 reaches the side edge of the body fixing portion 12 is formed on the side edge of the body fixing portion 12. The second oblique groove notch 32 is formed to penetrate through the body fixing portion 12.

The first and second front surface oblique grooves 27, 28 intersect on the front surface 12A of the body fixing portion 12. A front surface intersection 33 where the first and second front surface oblique grooves 27, 28 intersect is located on an axis connecting the wire 13 connected to the wire connecting portion 14, a center of the through hole 19 and the projection 20 (on the axis P).

[First and Second Front Surface Recesses 34, 35]

As shown in FIG. 2, a first front surface recess 34 having a triangular shape when viewed from above (an example of a direction intersecting the plate surfaces of the body fixing portion 12) is formed between a rear edge part of the front surface arc groove 23 and the first front surface oblique groove 27 on the front surface 12A of the body fixing portion 12. The first front surface recess 34 is formed by widening a bottom part of the front surface arc groove 23 and a bottom part of the first front surface oblique groove 27. Since the front surface arc groove 23 has an arc shape as described above, the first front surface recess 34 does not have a perfectly triangular shape, but has such a shape that can be substantially confirmed as a triangular shape. The first front surface recess 34 is formed at a position somewhat shifted to the left from the axis P of the wire 13 connected to the wire connecting portion 14.

A second front surface recess 35 having a triangular shape when viewed from above (the example of the direction intersecting the plate surfaces of the body fixing portion 12) is formed between the rear edge part of the front surface arc groove 23 and the second front surface oblique groove 28 on the front surface 12A of the body fixing portion 12. The second front surface recess 35 is formed by widening a bottom part of the front surface arc groove 23 and a bottom part of the second front surface oblique groove 28. Since the front surface arc groove 23 has an arc shape as described above, the second front surface recess 35 does not have a perfectly triangular shape, but has such a shape that can be substantially confirmed as a triangular shape. The second front surface recess 35 is formed at a position somewhat shifted to the right from the axis P of the wire 13 connected to the wire connecting portion 14.

[First and Second Reinforcing Ribs 36, 37]

As shown in FIG. 2, a first reinforcing rib 36 standing upward (the example of the direction intersecting the plate surfaces of the body fixing portion 12) is formed in a region between the first arc groove notch 24 and the second oblique groove notch 32 on the left side edge of the body fixing portion 12. A second reinforcing rib 37 standing upward is formed in a region between the second arc groove notch 25 and the first oblique groove notch 31 on the right side edge of the body fixing portion 12. By forming the first and second reinforcing ribs 36, 37, the body fixing portion 12 is less likely to be deformed in the direction intersecting the plate surfaces of the body fixing portion 12.

[Back Surface 12B of Body Fixing Portion 12]

Figure 4:
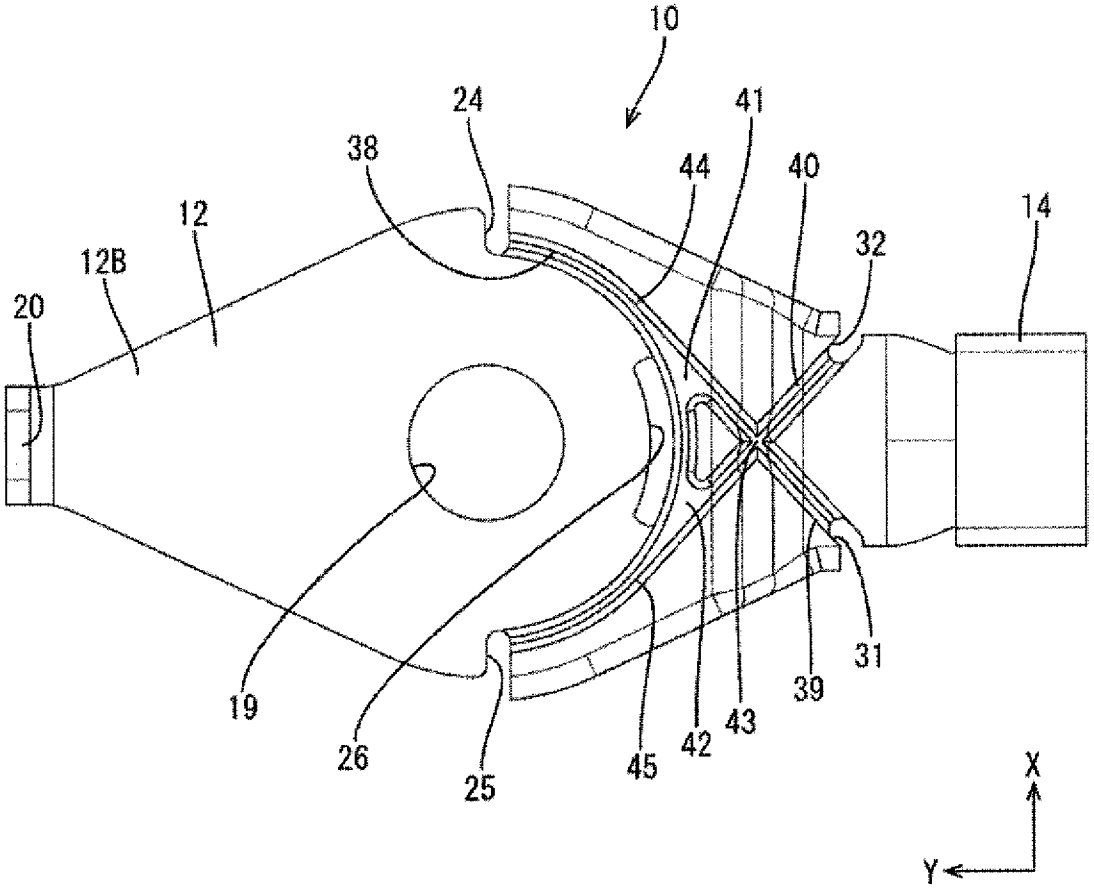
FIG. 4 is a bottom view showing the ground terminal.
Figure 5:
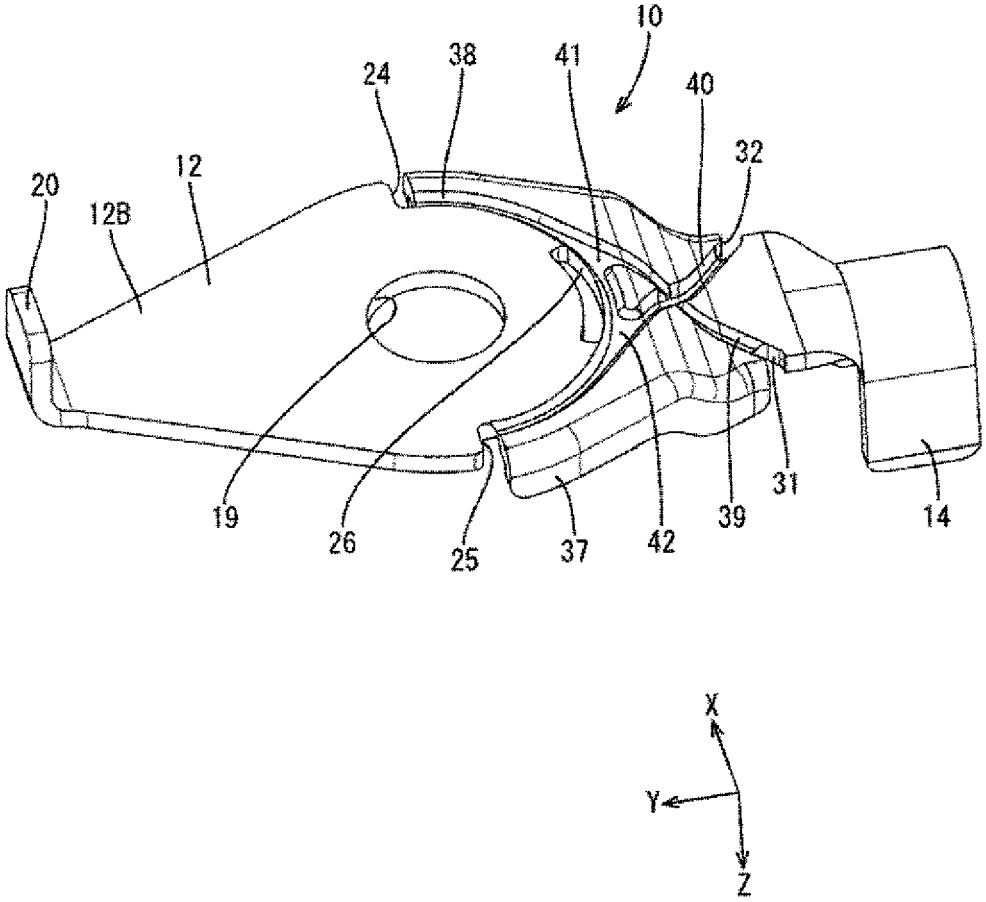
FIG. 5 is a perspective view showing a bottom surface of the ground terminal.

As shown in FIGS. 4 and 5, on the back surface 12B of the body fixing portion 12, a back surface arc groove 38 is formed at a position corresponding to the first front surface arc groove 23, a first back surface oblique groove 39 is formed at a position corresponding to the first front surface oblique groove 27, a second back surface oblique groove 40 is formed at a position corresponding to the second front surface oblique groove 28, a first back surface recess 41 is formed at a position corresponding to the first front surface recess 34, a second back surface recess 42 is formed at a position corresponding to the second front surface recess 35, a back surface intersection 43 is formed at a position corresponding to the front surface intersection 33, a first back surface contact point 44 is formed at a position corresponding to the first back surface contact point 44 and a second back surface contact point 45 is formed at a position corresponding to the second front surface contact point 30.

Figure 6:
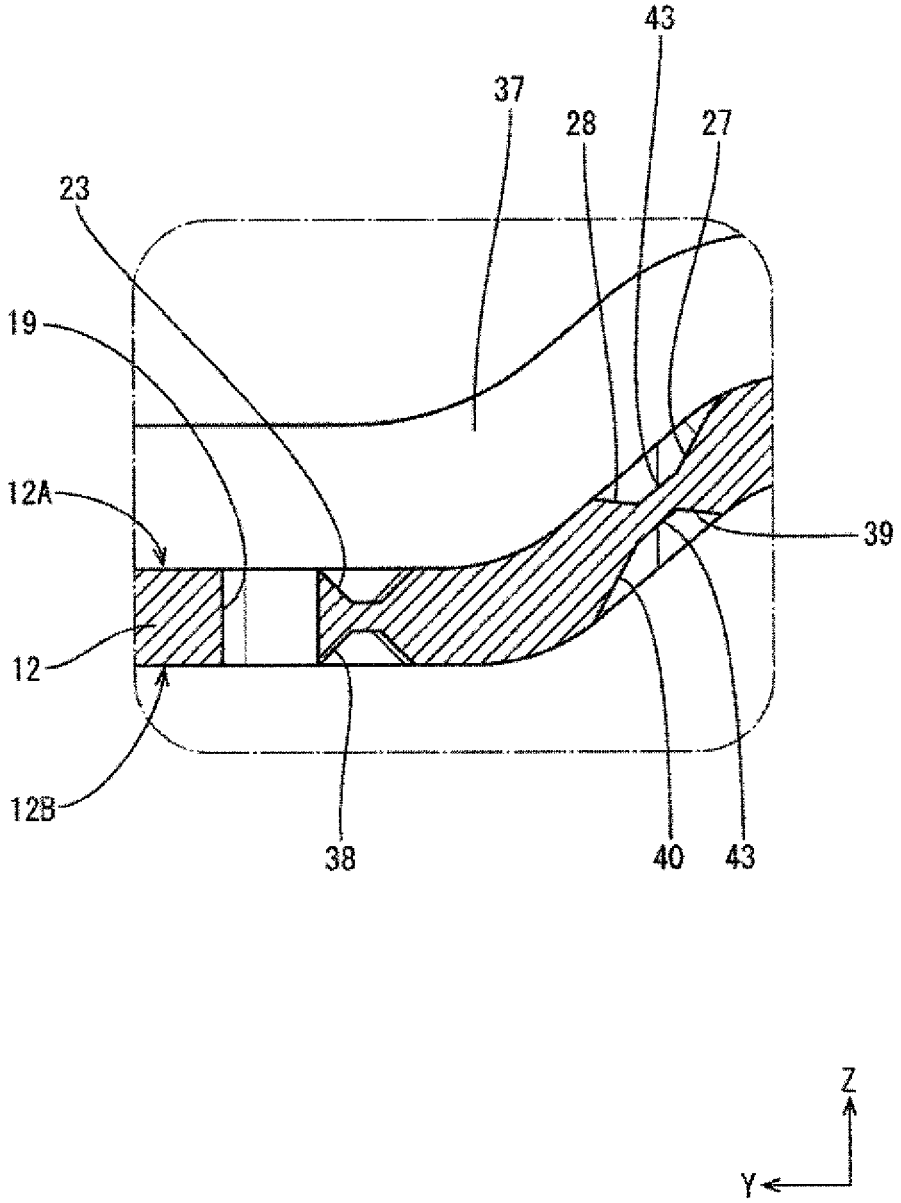
FIG. 6 is a partial enlarged section showing a breaking hole of the ground terminal.

In other words, as shown in FIG. 6, the front surface arc groove 23 and the back surface arc grooves 38 are formed side by side in the vertical direction, the first front surface oblique groove 27 and the first back surface oblique groove 39 are formed side by side in the vertical direction, the second front surface oblique groove 28 and the second back surface oblique groove 40 are formed side by side in the vertical direction, the first front surface recess 34 and the first back surface recess 41 are formed side by side in the vertical direction, the second front surface recess 35 and the second back surface recess 42 are formed side by side in the vertical direction, and the front surface intersection 33 and the back surface intersection 43 are formed side by side in the vertical direction in a section along a plane orthogonal to the plate surfaces of the body fixing portion 12.

Further, the first front surface contact point 29 and the first back surface contact point 44 are formed side by side in the vertical direction, and the second front surface contact point 30 and the second back surface contact point 45 are formed side by side in the vertical direction.

[Functions and Effects of Embodiment]

Next, functions and effects of this embodiment are described. The body fixing portion 12 of the ground terminal 10 having the wire 13 connected to the wire connecting portion 14 is placed on the body 11 with the back surface 12B faced toward the body 11. At this time, the projection 20 of the ground terminal 10 is inserted into the insertion hole 21 of the body 11 from above. The shaft portion 18 of the bolt 17 is inserted into the through hole 19 from above and further inserted into the body through hole 46 of the body 11. The unillustrated nut is threadably engaged with the shaft portion of the bolt 17. In this way, the ground terminal 10 is fixed to the body 11 and the wire 13 is electrically connected to the body 11.

Figure 7:
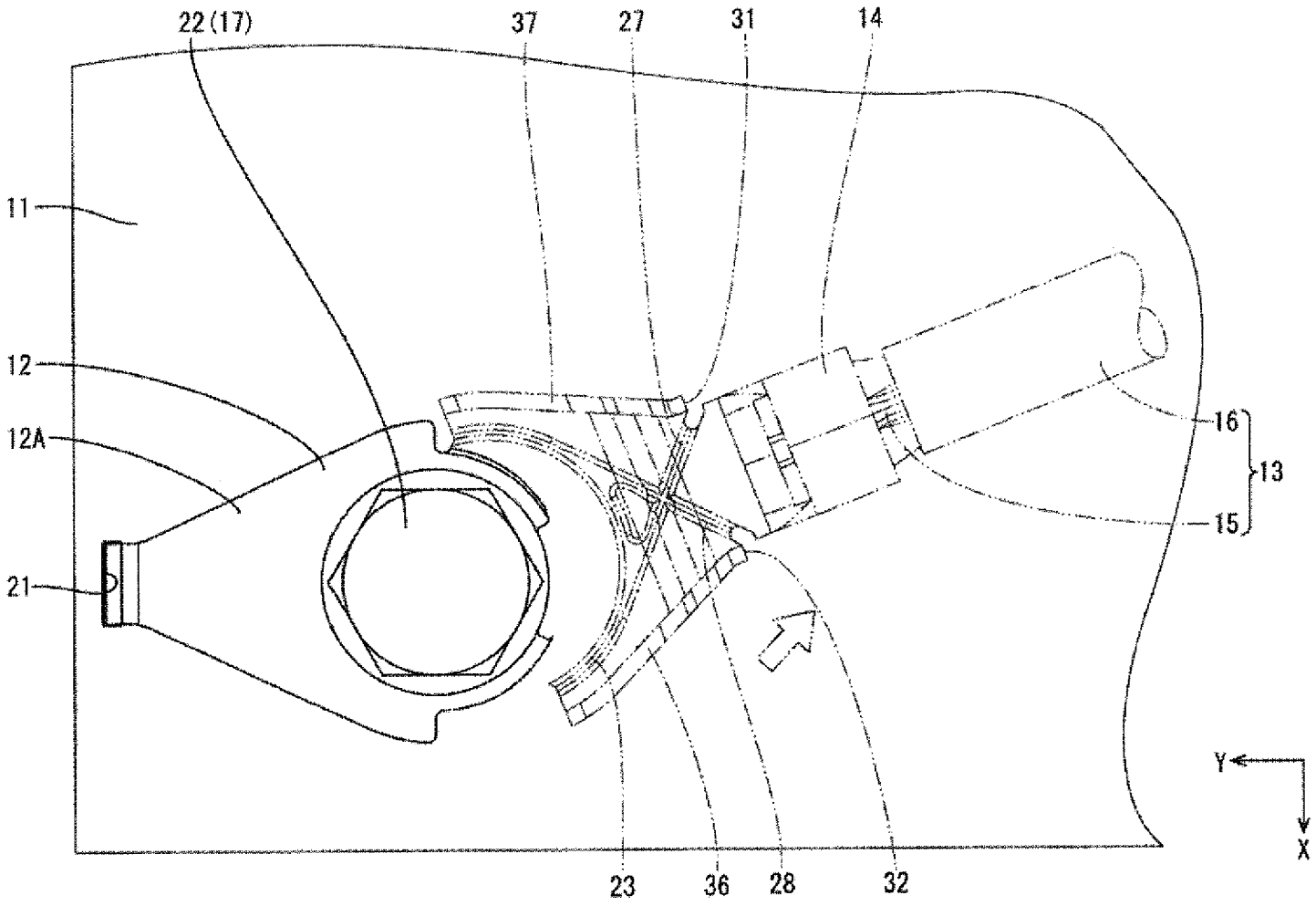
FIG. 7 is a plan view showing a state where the ground terminal is broken.

At the time of dismantling the vehicle, a hook of an unillustrated crane is hooked to the wire 13. The wire 13 is strongly pulled up by the crane. At this time, if the front surface 12A of the body fixing portion 12 is, for example, mounted on the body 11 in an upward facing posture with respect to gravity, the ground terminal 10 is broken at the front and back surface arc grooves 23, 38, and a part of the body fixing portion 12 fixed by the bolt 17 remains on the body 11 and a part of the body fixing portion 12 connected to the wire 13 and the wire connecting portion 14 and behind the front and back surface arc grooves 23, 38 is removed from the body 11 (see FIG. 7). Note that the ground terminal 10 is not necessarily attached to the body 11 with the front surface 12A of the body fixing portion 12 facing vertically upward. A state where a force in a direction upward with respect to gravity and somewhat inclined to the right is applied to the wire 13 is illustrated in FIG. 7.

If the ground terminal 10 is attached to the body 11 in a posture different from the posture in which the front surface 12A of the body fixing portion 12 is facing vertically upward with respect to gravity, a force in a clockwise or counter-clockwise direction about the shaft portion 18 of the bolt 17 such as a direction indicated by an arrow A or a direction indicated by an arrow B in FIG. 2 is applied to the ground terminal 10 via the wire 13. Then, there is a concern that stress does not necessarily concentrate on the front and back surface arc grooves 23, 38 and the body fixing portion 12 becomes less likely to be broken at the front and back surface arc grooves 23, 38.

This embodiment relates to the ground terminal 10 to be attached to the body 11 and including the body fixing portion 12 to be fixed to the body 11 and the wire connecting portion 14 to be connected to the wire 13, wherein the body fixing portion 12 is plate-like, includes the through hole 19 through which the shaft portion 18 of the bolt 17 is inserted, and is formed with the arcuate front and back surface arc grooves 23, 38 along the peripheral edge of the through hole 19, the first and second front surface oblique grooves 27, 28 connected to the front surface arc groove 23 and extending to intersect the extending direction of the wire 13 connected to the wire connecting portion 14 and the first and second back surface oblique grooves 39, 40 connected to the back surface arc groove 38 and extending to intersect the extending direction of the wire 13 connected to the wire connecting portion 14.

If the wire 13 receives a force in the direction indicated by the arrow A of FIG. 2, stress concentrates on the first oblique groove notch 31 of the body fixing portion 12. Then, the body fixing portion 12 starts to be broken at the first oblique groove notch 31. A crack formed in the first oblique groove notch 31 grows forward along the first front surface oblique groove 27 and the first back surface oblique groove 39. In FIG. 2, a direction of growth of the crack is schematically shown by one-dot chain line L. The crack grown along the first front surface oblique groove 27 and the first back surface oblique groove 39 reaches the front surface arc groove 23 through the first front surface contact point 29 and reaches the back surface arc groove 38 through the first back surface contact point 44. Further, if the front and back surface arc grooves 23, 38 are broken and the crack reaches the first arc groove notch 24, a part of the body fixing portion 12 to the left of the front and back surface arc grooves 23, 38 and behind the one-dot chain line L is removed from the body 11 together with the wire 13.

If the wire 13 receives a force in the direction indicated by the arrow B of FIG. 2, stress concentrates on the second oblique groove notch 32 of the body fixing portion 12. Then, the body fixing portion 12 starts to be broken at the second oblique groove notch 32. A crack formed in the second oblique groove notch 32 grows forward along the second front surface oblique groove 28 and the second back surface oblique groove 40. In FIG. 2, a direction of growth of the crack is schematically shown by one-dot chain line M. The crack grown along the second front surface oblique groove 28 and the second back surface oblique groove 40 reaches the front surface arc groove 23 through the second front surface contact point 30 and reaches the back surface arc groove 38 through the second back surface contact point 45. Further, if the front and back surface arc grooves 23, 38 are broken and the crack reaches the second arc groove notch 25, a part of the body fixing portion 12 to the right of the front and back surface arc grooves 23, 38 and behind the one-dot chain line M is removed from the body 11 together with the wire 13.

As just described, in this embodiment, the ground terminal 10 can be easily broken even if forces in various directions are applied.

In this embodiment, the front and back surface arc grooves 23, 38 are formed in the region outside the part of the body fixing portion 12 where the head portion 22 of the bolt 17 and the body fixing portion 12 are in contact, with the body fixing portion 12 fixed to the body 11 by the bolt 17.

The body fixing portion 12 broken at the front and back surface arc grooves 23, 38 by receiving a force from the wire 13 is divided into the part sandwiched between the head portion 22 of the bolt 17 and the body and the region outside the part where the head portion 22 of the bolt 17 and the body fixing portion 12 are in contact. In this way, the part connected to the wire 13 and the wire connecting portion 14 and behind the front and back surface arc grooves 23, 38 is easily removed from the body fixing portion 12.

According to this embodiment, the front and back surface arc grooves 23, 38 are formed between the through hole 19 and the wire connecting portion 14 in the body fixing portion 12. In this way, a force received from the wire 13 is not received by the part fixed by the bolt 17, but is transmitted to the front and back surface arc grooves 23, 38, wherefore the body fixing portion 12 of the ground terminal 10 is easily broken at the front and back surface arc grooves 23, 38.

According to this embodiment, the first front surface oblique groove 27 is formed along the tangent to the first front surface contact point 29 of the front surface arc groove 23, the first back surface oblique groove 39 is formed along a tangent to the first back surface contact point 44 of the back surface arc groove 38, the second front surface oblique groove 28 is formed along the tangent to the second front surface contact point 30 of the front surface arc groove 23, and the second back surface oblique groove 40 is formed along a tangent to the second back surface contact point 45 of the back surface arc groove 38.

A crack grown along the first front surface oblique groove 27 smoothly extends from the first front surface contact point 29 to the front surface arc groove 23. Further, a crack grown along the first back surface oblique groove 39 smoothly extends from the first back surface contact point 44 to the back surface arc groove 38. In this way, if a crack is formed at the first front surface oblique groove 27 and the first back surface oblique groove 39, this crack can be easily caused to grow to the front and back surface arc grooves 23, 38. In this way, the ground terminal 10 is broken at the front and back surface arc grooves 23, 38, wherefore the part connected to the wire 13 and the wire connecting portion 14 and behind the front and back surface arc grooves 23, 38 is easily removed from the body 11.

A crack grown along the second front surface oblique groove 28 smoothly extends from the second front surface contact point 30 to the front surface arc groove 23. Further, a crack grown along the second back surface oblique groove 40 smoothly extends from the second back surface contact point 45 to the back surface arc groove 38. In this way, if a crack is formed at the second front surface oblique groove 28 and the second back surface oblique groove 40, this crack can be easily caused to grow to the front and back surface arc grooves 23, 38. In this way, the ground terminal 10 is broken at the front and back surface arc grooves 23, 38, wherefore the part connected to the wire 13 and the wire connecting portion 14 and behind the front and back surface arc grooves 23, 38 is easily removed from the body 11.

According to this embodiment, the body fixing portion 12 is formed with the first front surface recess 34 having a triangular shape when viewed from the direction intersecting the plate surfaces of the body fixing portion 12 in the part where the front surface arc groove 23 and the first front surface oblique groove 27 are connected, the second front surface recess 35 having a triangular shape when viewed from the direction intersecting the plate surfaces of the body fixing portion 12 in the part where the front surface arc groove 23 and the second front surface oblique groove 28 are connected, the first back surface recess 41 having a triangular shape when viewed from the direction intersecting the plate surfaces of the body fixing portion 12 in the part where the back surface arc groove 38 and the first back surface oblique groove 39 are connected, and the second back surface recess 42 having a triangular shape when viewed from the direction intersecting the plate surfaces of the body fixing portion 12 in the part where the back surface arc groove 38 and the second back surface oblique groove 40 are connected.

Since the body fixing portion 12 is thinned in the vertical direction in the part where the first front surface recess 34 and the first back surface recess 41 are formed and the part where the second front surface recess 35 and the second back surface recess 42 are formed, the body fixing portion 12 can be easily broken.

According to this embodiment, the first front surface oblique groove 27, the first back surface oblique groove 39, the second front surface oblique groove 28 and the second back surface oblique groove 40 extend to the side edge of the body fixing portion 12. Since the breakage of the body fixing portion 12 easily progresses from the parts where the first front surface oblique groove 27, the first back surface oblique groove 39, the second front surface oblique groove 28 and the second back surface oblique groove 40 reach the side edge of the body fixing portion 12 in this way, the ground terminal 10 can be easily divided.

According to this embodiment, the first oblique groove notch 31 cut from the right side edge of the body fixing portion 12 toward the first front surface oblique groove 27 and the first back surface oblique groove 39 is formed in the part of the side edge of the body fixing portion 12 where the first front surface oblique groove 27 and the first back surface oblique groove 39 reach the right side edge of the body fixing portion 12, and the second oblique groove notch 32 cut from the left side edge of the body fixing portion 12 toward the second front surface oblique groove 28 and the second back surface oblique groove 40 is formed in the part of the side edge of the body fixing portion 12 where the second front surface oblique groove 28 and the second back surface oblique groove 40 reach the left side edge of the body fixing portion 12. In this way, the body fixing portion 12 is easily broken from the first and second oblique groove notches 31, 32, wherefore the ground terminal 10 can be easily divided.

According to this embodiment, on the side edge of the body fixing portion 12, the first arc groove notch 24 cut toward the left end part of the front surface arc groove 23 and the left end part of the back surface arc groove 38 is formed at the position corresponding to the left end part of the front surface arc groove 23 and the left end part of the back surface arc groove 38, and the second arc groove notch 25 cut toward the right end part of the front surface arc groove 23 and the right end part of the back surface arc groove 38 is formed at the position corresponding to the right end part of the front surface arc groove 23 and the right end part of the back surface arc groove 38.

A crack formed in the front and back surface arc grooves 23, 38 when a force is applied to the wire 13 grows to both left and right end parts of the front and back surface arc grooves 23, 38 and reaches the first and second arc groove notches 24, 25, whereby the body fixing portion 12 is broken. In this way, the ground terminal 10 can be easily divided. According to this embodiment, the body fixing portion 12 includes the breaking hole 26 penetrating through the body fixing portion 12 near the front and back surface arc grooves 23, 38.

If the wire 13 receives a force to be pulled rearward, stress concentrates on the breaking hole 26 and the body fixing portion 12 starts to be broken from the hole edge of the breaking hole 26. Then, a crack reaches the front and back surface arc grooves 23, 38 formed near the breaking hole 26 and the breakage of the body fixing portion 12 further progresses in the front or back surface arc groove 23, 38. In this way, the ground terminal can be easily divided if the wire 13 receives a force to be pulled rearward.

According to this embodiment, the front and back surface arc grooves 23, 38 extend from both ends of the breaking hole 26.

A crack formed in the hole edge of the breaking hole 26 quickly extends to the front and back surface arc grooves 23, 38 extending from the both ends of the breaking hole 26, and the breakage of the body fixing portion 12 progresses along the front and back surface arc grooves 23, 38. In this way, the ground terminal 10 can be easily divided.

According to this embodiment, the first front surface oblique groove 27 and the first back surface oblique groove 39 extend at an angle of $\pi/4$ radians with respect to the extending direction of the wire 13 fixed to the wire connecting portion 14, and the second front surface oblique groove 28 and the second back surface oblique groove 39 extend at an angle of $-\pi/4$ radians with respect to the extending direction of the wire 13 fixed to the wire connecting portion 14.

As shown in FIG. 2, if an external force is applied to the wire 13 in the direction indicated by the arrow A, stress concentrates on the first front surface oblique groove 27 and the first back surface oblique groove 39 formed to extend at the angle of $\pi/4$ radians with respect to the extending direction of the wire 13 fixed to the wire connecting portion 14, wherefore breakage easily occurs. Further, if an external force is applied to the wire 13 in the direction indicated by the arrow B, stress concentrates on the second front surface oblique groove 28 and the second back surface oblique groove 40 formed to extend at the angle of $-\pi/4$ radians with respect to the extending direction of the wire 13 fixed to the wire connecting portion 14, wherefore breakage easily occurs. In this way, the ground terminal 10 can be easily divided even if forces in various directions are applied to the wire 13.

In this embodiment, the first and second front surface oblique grooves 27, 28 are formed in the front surface 12A of the body fixing portion 12, and intersect each other. Further, the first and second back surface oblique grooves 39, 40 are formed in the back surface 12B of the body fixing portion 12, and intersect each other.

Even if a crack grows along only one of the first and second front surface oblique grooves 27, 28, the crack grows to the other of the first and second front surface oblique grooves 27, 28 at the front surface intersection 33, and the breakage of the body fixing portion 12 progresses along both the first and second front surface oblique grooves 27, 28. Similarly, even if a crack grows along only one of the first and second back surface oblique grooves 39, 40, the crack grows to the other of the first and second back surface oblique grooves 39, 40 at the back surface intersection 43, and the breakage of the body fixing portion 12 progresses along both the first and second back surface oblique grooves 39, 40. In this way, the ground terminal 10 is easily broken.

According to this embodiment, the front surface arc groove 23, the first front surface oblique groove 27 and the second front surface oblique groove 28 are formed in the front surface 12A of the body fixing portion 12, and the back surface arc groove 38, the first back surface oblique groove 39 and the second back surface oblique groove 40 are formed in the back surface 12B of the body fixing portion 12. In this way, the breakage of the body fixing portion 12 progresses in both the front and back surfaces 12A, 12B of the body fixing portion 12, wherefore the ground terminal 10 is easily broken.

According to this embodiment, the first back surface oblique groove 39 formed in the back surface 12B of the body fixing portion 12 is formed at the position corresponding to the first front surface oblique groove 27 formed in the front surface 12A of the body fixing portion 12. Further, the second back surface oblique groove 40 formed in the back surface 12B of the body fixing portion 12 is formed at the position corresponding to the second front surface oblique groove 28 formed in the front surface 12A of the body fixing portion 12. In this way, a vertical thickness of the body fixing portion 12 is smaller as compared to the case where an oblique groove is formed only in one of the front and back surfaces 12A, 12B of the body fixing portion 12, wherefore the ground terminal 10 is more easily broken.

According to this embodiment, on the side edge of the body fixing portion 12, the first and second reinforcing ribs 36, 37 standing up from the plate surface of the body fixing portion 12 are formed in the areas where the front surface arc groove 23, the back surface arc groove 38, the first front surface oblique groove 27, the first back surface oblique groove 39, the second front surface oblique groove 28 and the second back surface oblique groove 40 are formed.

By forming the front surface arc groove 23, the back surface arc groove 38, the first front surface oblique groove 27, the first back surface oblique groove 39, the second front surface oblique groove 28 and the second back surface oblique groove 40 in the body fixing portion 12, the body fixing portion 12 is easily broken. However, it is desired to avoid the breakage of the body fixing portion 12 at a timing different from a timing of dismantling the vehicle due to vibration applied to the wire 13 and the ground terminal 10 during the travel of the vehicle. According to this embodiment, since the regions where the front surface arc groove 23, the back surface arc groove 38, the first front surface oblique groove 27, the first back surface oblique groove 39, the second front surface oblique groove 28 and the second back surface oblique groove 40 are formed are reinforced on the side edge of the body fixing portion 12 by the first and second reinforcing ribs 36, 37, the breakage of the ground terminal 10 during the travel of the vehicle can be avoided.

According to this embodiment, the projection 20 extending in the direction intersecting the plate surfaces of the body fixing portion 12 is formed on the side edge of the body fixing portion 12, and the projection 20 is inserted into the insertion hole 21 formed in the body 11. By inserting the projection 20 into the insertion hole 21 of the body 11, the ground terminal 10 can be easily positioned when being fixed to the body 11. In this way, the efficiency of an operation of assembling the ground terminal 10 with the body 11 is improved.

Second Embodiment

Figure 8:
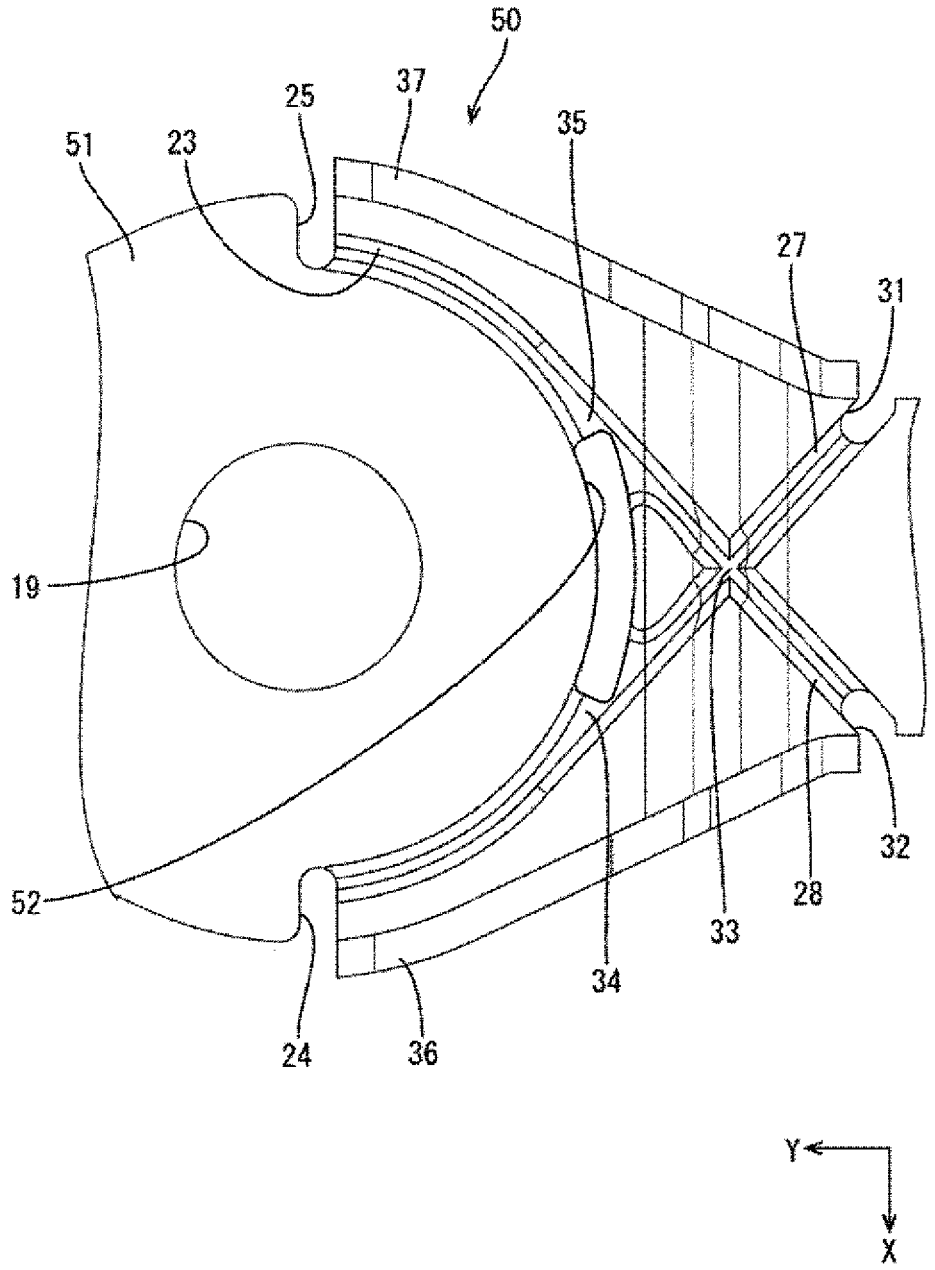
FIG. 8 is a partial enlarged plan view showing a ground terminal according to a second embodiment.

A second embodiment is described with reference to FIG. 8. The front end of a breaking hole 52 is formed along a front edge part of a front surface arc groove 23 and the rear end thereof is formed along a hole edge part of the front surface arc groove 23 in a body fixing portion 51 of a ground terminal 50 according to this embodiment. Further, both left and right end parts of the breaking hole 52 are respectively located in first and second front surface recesses 34, 35 and continuous with the front surface arc groove 23.

Although not shown in detail, the front end of the breaking hole 52 is formed along a front edge part of a back surface arc groove 38 and the rear end thereof is formed along a hole edge part of the back surface arc groove 38. Further, both left and right end parts of the breaking hole 52 are respectively located in first and second back surface recesses 41, 42 and continuous with the back surface arc groove 38.

Since the configuration other than the above is substantially the same as that of the first embodiment, the same members are denoted by the same reference signs and repeated description is omitted.

In the body fixing portion 51 of the ground terminal 50 according to this embodiment, the front and back surface arc grooves 23, 38 are provided continuously with the both ends of the breaking hole 52. In this way, the both end parts of the breaking hole 52 are broken to form cracks, and these cracks quickly grow along the front and back surface arc grooves 23, 38. In this way, the ground terminal 50 can be easily broken.

Third Embodiment

Figure 9:
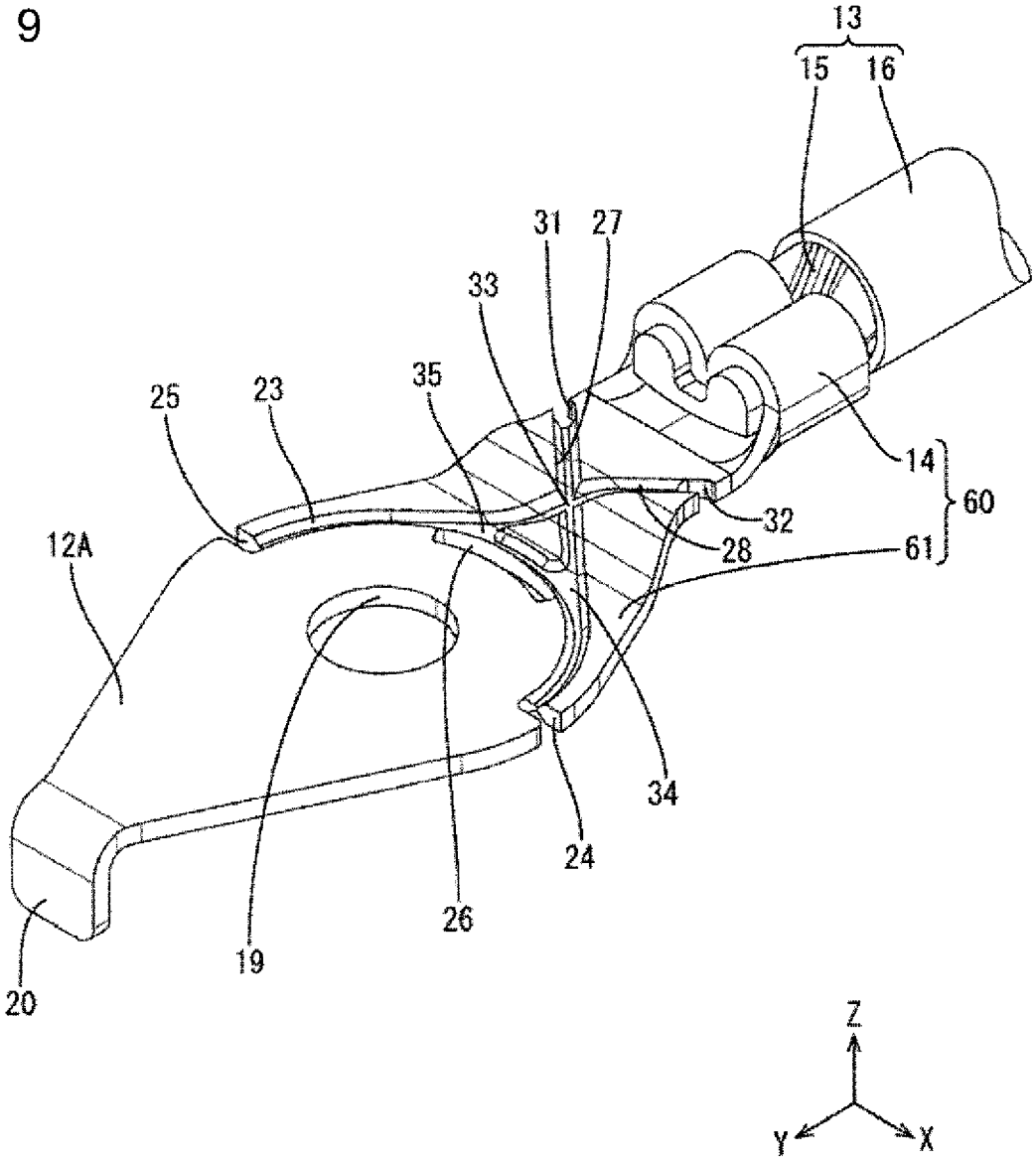
FIG. 9 is a perspective view showing a ground terminal according to a third embodiment.

A third embodiment is described with reference to FIG. 9. A ground terminal 60 according to this embodiment is not formed with first and second reinforcing ribs on a side edge of a body fixing portion 61. Since the configuration other than the above is substantially the same as that of the first embodiment, the same members are denoted by the same reference signs and repeated description is omitted.

Since the first and second reinforcing ribs are not formed on the side edge of the body fixing portion 61 in this embodiment, the ground terminal 60 can be reduced in size and weight. Further, a yield of a member is improved.

Fourth Embodiment

Figure 10:
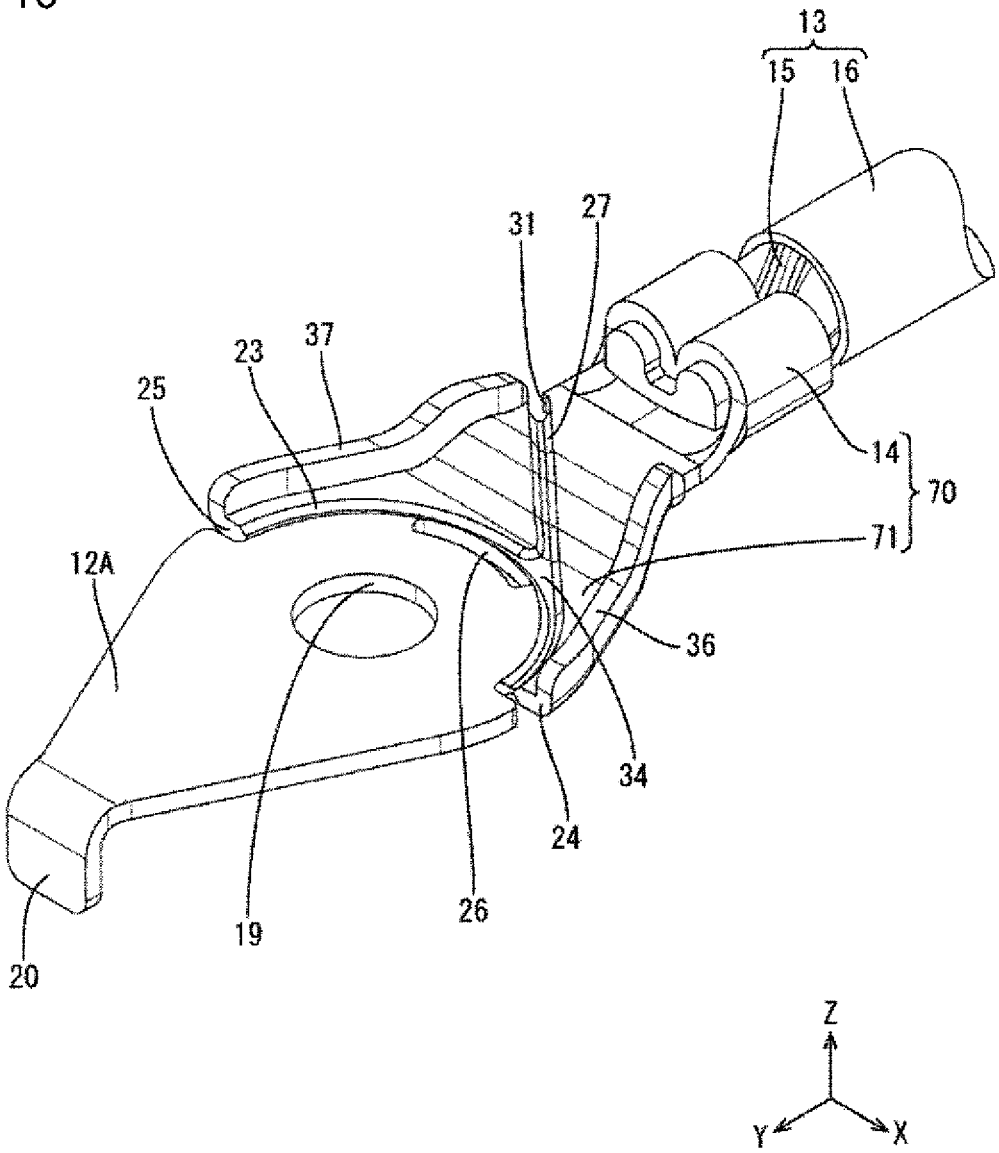
FIG. 10 is a perspective view showing a ground terminal according to a fourth embodiment.
Figure 11:
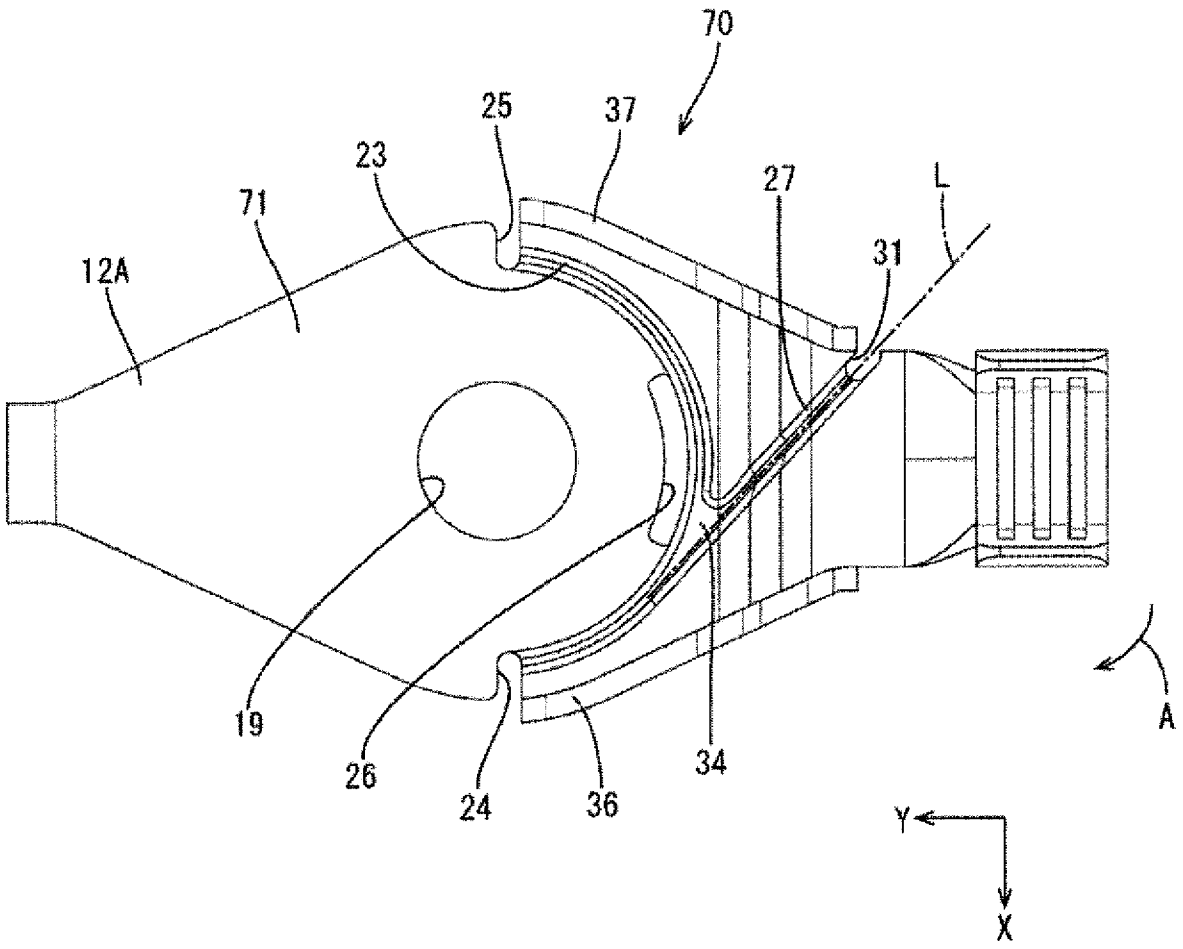
FIG. 11 is a plan view showing the ground terminal.
Figure 12:
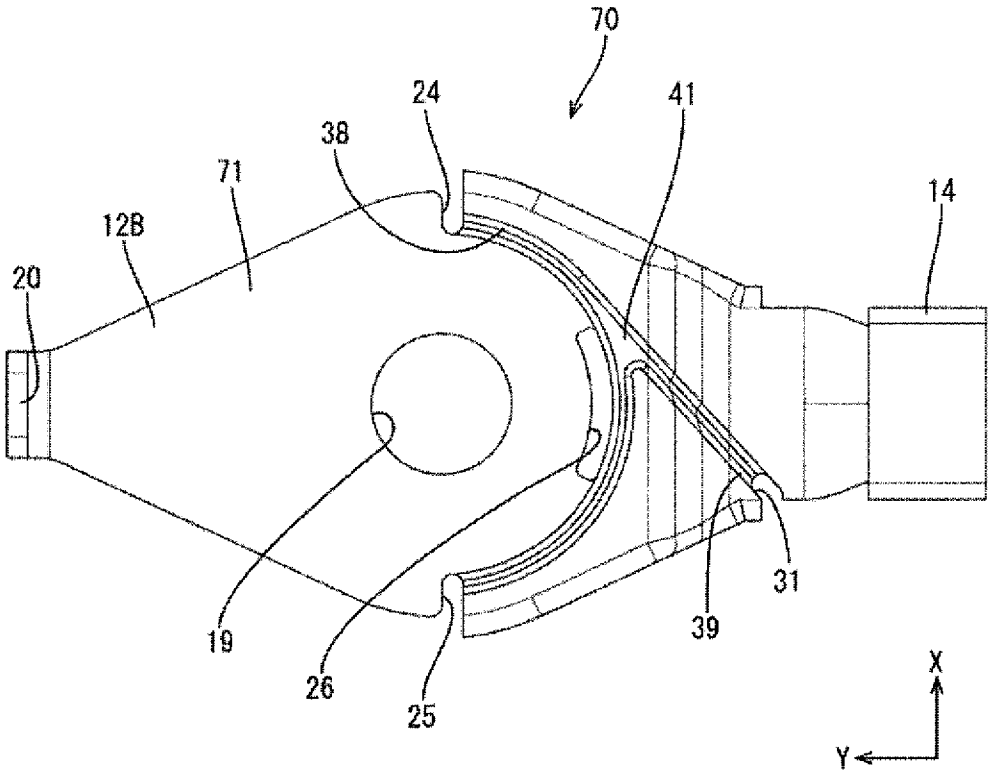
FIG. 12 is a bottom view showing the ground terminal.
Figure 13:
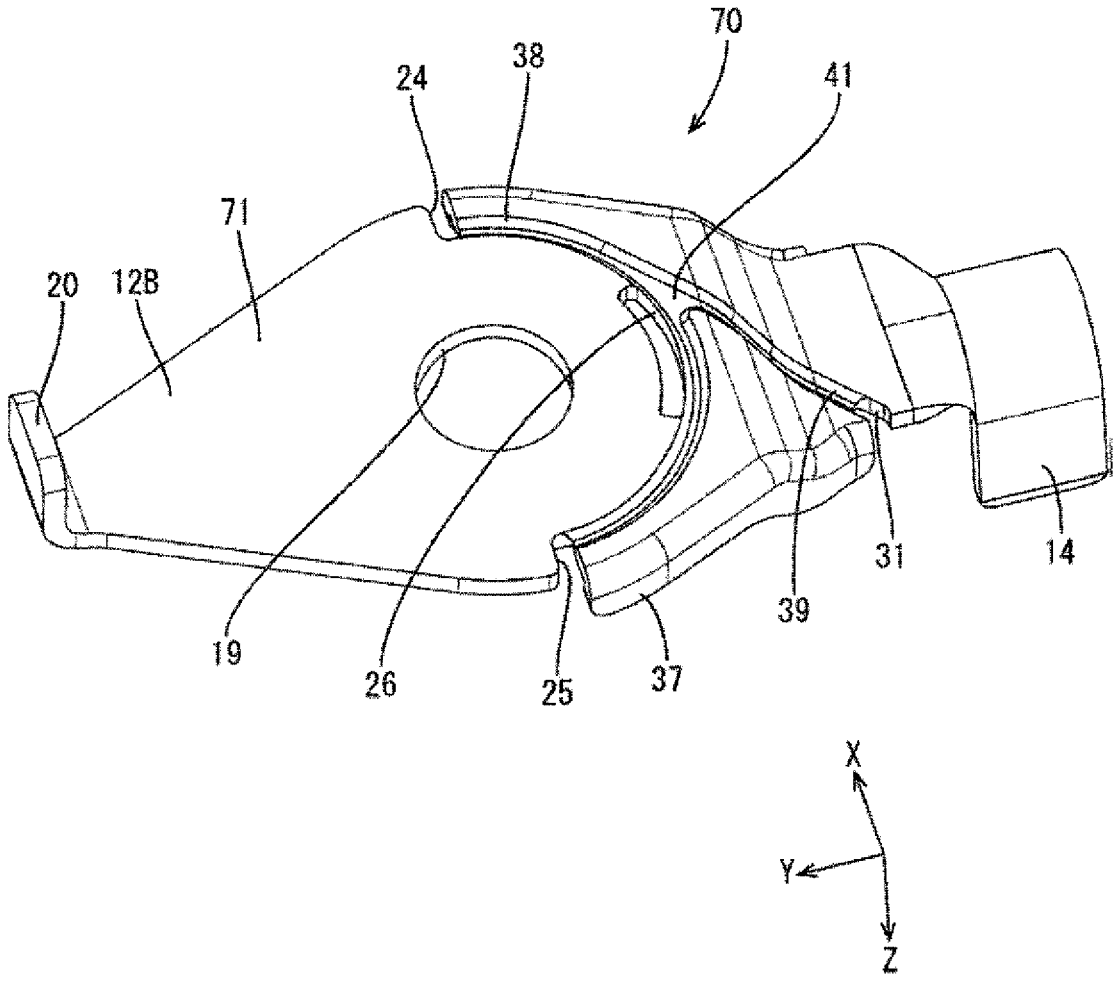
FIG. 13 is a perspective view showing a bottom surface of the ground terminal.

A fourth embodiment is described with reference to FIGS. 10 to 13. In a ground terminal 70 according to this embodiment, a second front surface oblique groove and a second front surface recess are not provided in a front surface 12A of a body fixing portion 71 as shown in FIGS. 10 and 11. Further, as shown in FIGS. 12 and 13, a second back surface oblique groove and a second back surface recess are not provided in a back surface 12B of the body fixing portion 71. Further, a second oblique groove notch is not provided in a side edge of the body fixing portion 71. Since the configuration other than the above is substantially the same as that of the first embodiment, the same members are denoted by the same reference signs and repeated description is omitted.

According to this embodiment, if a wire 13 receives a force in a direction indicated by an arrow A as shown in FIG. 11, the body fixing portion 71 is broken along a first front surface oblique groove 27 and a first back surface oblique groove 39. In this way, the ground terminal 70 can be easily divided as compared to the case where the first front surface oblique groove 27 and the first back surface oblique groove 39 are not provided.

According to this embodiment, the manufacturing cost of the ground terminal 70 can be reduced since the body fixing portion 71 is not provided with the second front surface oblique groove, the second back surface oblique groove, the second oblique groove notch, the second front surface recess and the second back surface recess.

Fifth Embodiment

Figure 14:
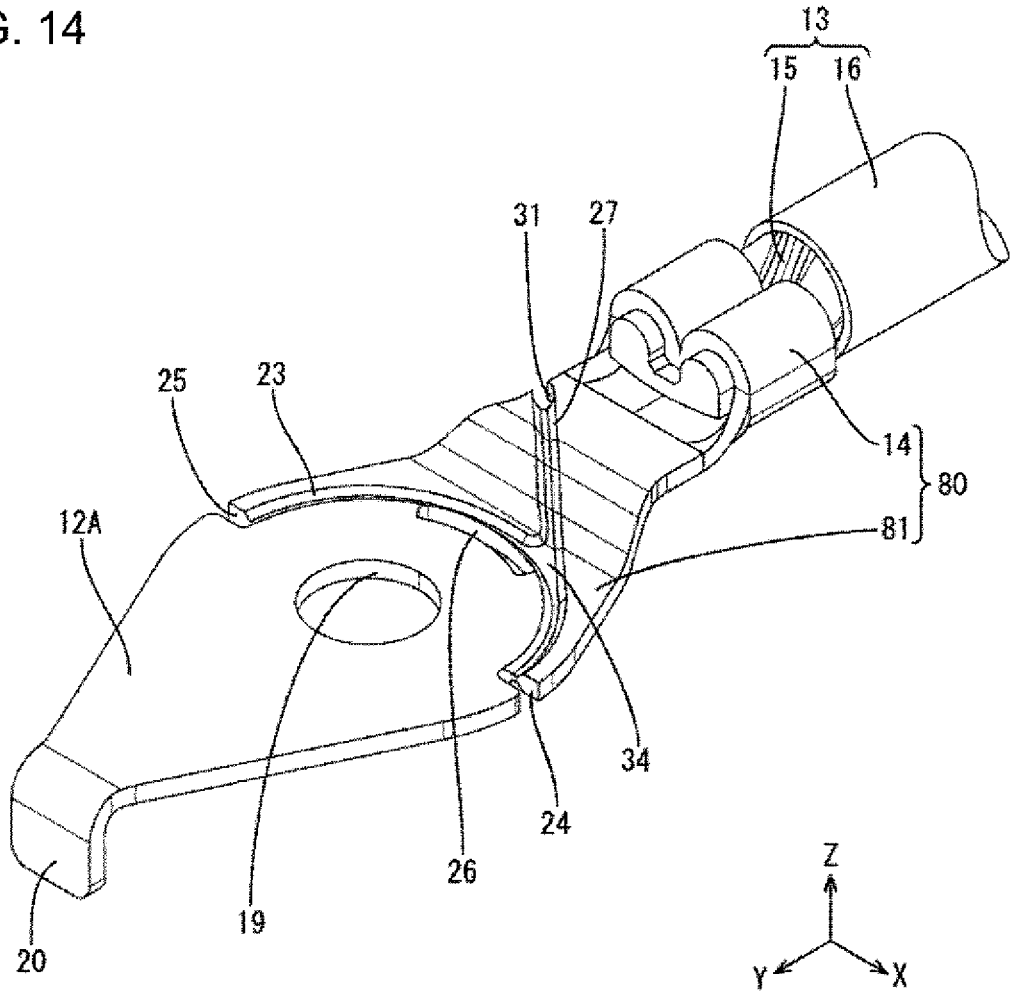
FIG. 14 is a perspective view showing a ground terminal according to a fifth embodiment.

A fifth embodiment is described with reference to FIG. 14. A ground terminal 80 according to this embodiment is not formed with first and second reinforcing ribs on a side edge of a body fixing portion 81. Since the configuration other than the above is substantially the same as that of the fourth embodiment, the same members are denoted by the same reference signs and repeated description is omitted.

Since the first and second reinforcing ribs are not formed on the side edge of the body fixing portion 81 in this embodiment, the ground terminal 80 can be reduced in size and weight. Further, a yield of a member is improved.

Other Embodiments

Although the front end of the breaking hole 52 is formed along the front end edges of the front and back surface arc grooves 23, 38 and the rear end thereof is formed along the rear end edges of the front and back surface arc grooves 23, 38 in the ground terminal 50 according to the second embodiment, there is no limitation to this. For example, various shapes can be employed as shown in FIGS. 15 to 17.

Figure 15:
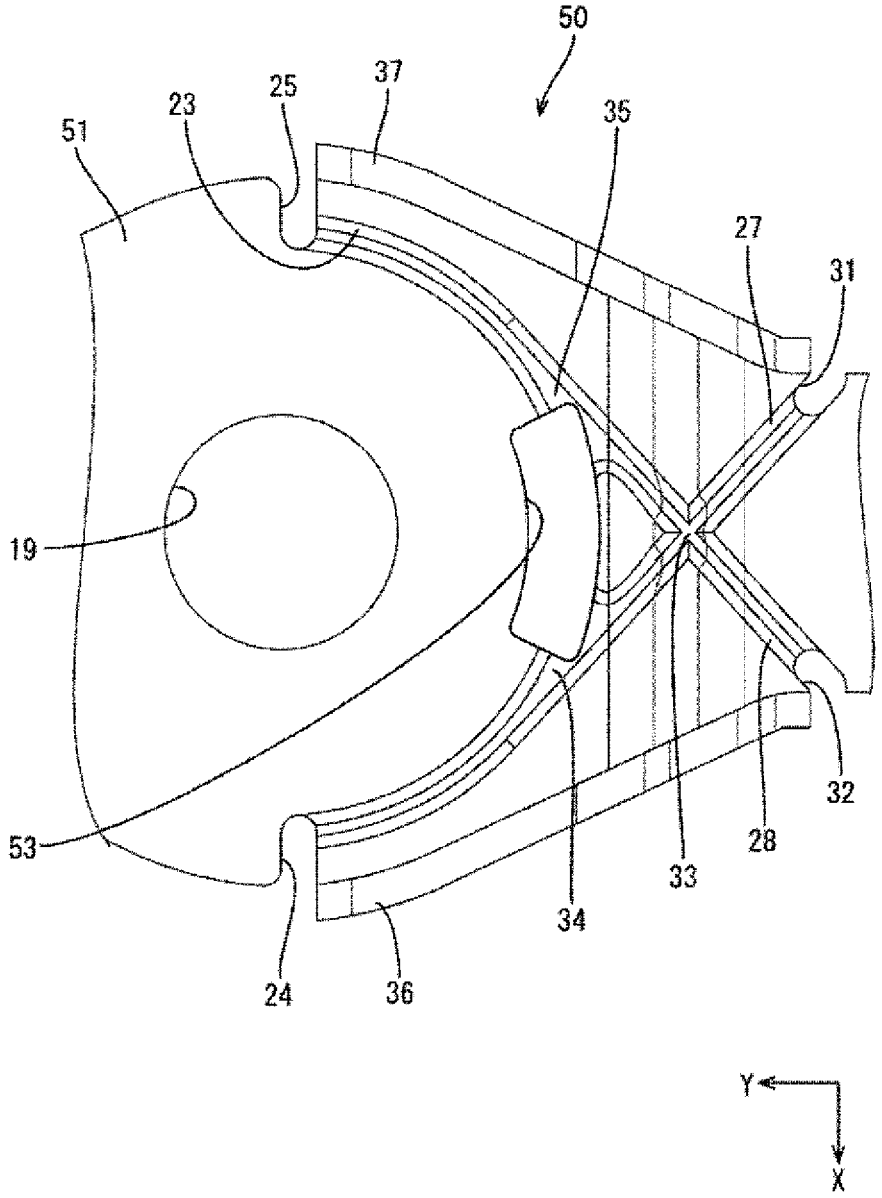
FIG. 15 is a partial enlarged plan view showing a breaking hole of a ground terminal described in another embodiment (1).

As shown in FIG. 15, the front end of a breaking hole 53 may be formed in front of the front end edges of the front and back surface arc grooves 23, 38, and the rear end thereof may be formed behind the rear end edges of the front and back surface arc grooves 23, 38.

Figure 16:
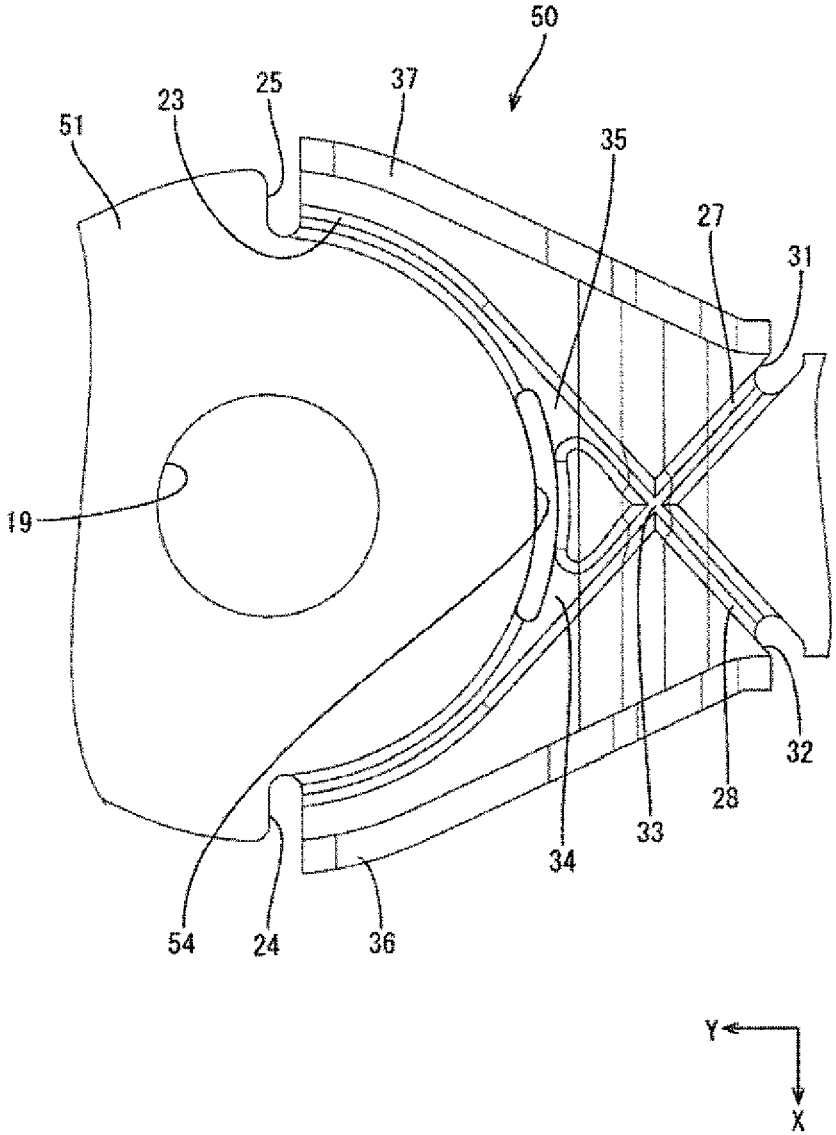
FIG. 16 is a partial enlarged plan view showing a breaking hole of a ground terminal described in the other embodiment (1).

As shown in FIG. 16, the rear end of a breaking hole 54 may be formed in front of the rear end edges of the front and back surface arc grooves 23, 38.

Figure 17:
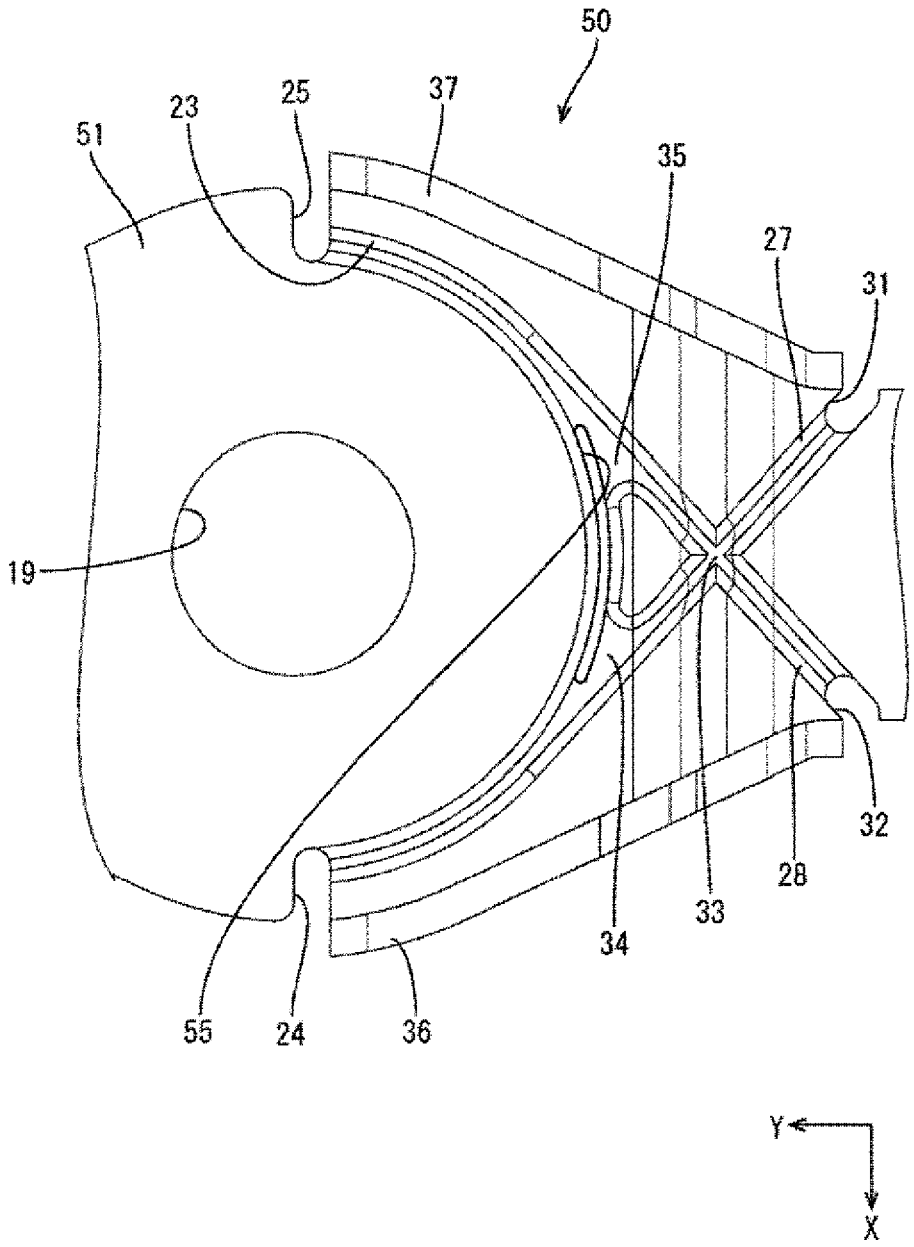
FIG. 17 is a partial enlarged plan view showing a breaking hole of a ground terminal described in the other embodiment (1).

As shown in FIG. 17, the front end of a breaking hole 55 may be formed behind the front end edges of the front and back surface arc grooves 23, 38 and the rear end thereof may be formed in front of the rear end edges of the front and back surface arc grooves 23, 38.

The oblique groove notches may be omitted.

The arc groove notches may be omitted.

The reinforcing ribs may be omitted.

The projection 20 may be omitted.

The wire 13 may be welded to the wire connecting portion.

The wire connecting portion 14 of the ground terminal may include an insulation barrel to be crimped to the outer periphery of the insulation coating 16 of the wire 13.

The arc groove may not have a ½ arc shape and can have an arbitrary arc shape such as a ¼ arc shape or ⅓ arc shape.

The angle formed between the axis P of the wire 13 and the oblique groove is not limited to $\pi/4$ radians or $-\pi/4$ radians and can be an arbitrary value.

Although the head 22 of the bolt 17 contacts the body fixing portion 12, there is no limitation to this. A nut may be threadably engaged with a stud bolt (an example of the fixing member) inserted through the through hole 19, and this nut may contact the body fixing portion 12.

LIST OF REFERENCE SIGNS

10, 50, 60, 70, 80: ground terminal
11: body
12, 51, 61, 71, 81: body fixing portion
12A: front surface of body fixing portion
12B: back surface of body fixing portion
13: wire
14: wire connecting portion
15: core
16: insulation coating
17: bolt
18: shaft portion
19: through hole
20: projection
21: insertion hole
22: head portion
23: front surface arc groove
24: first arc groove notch
25: second arc groove notch
26, 52, 53, 54, 55: breaking hole
27: first front surface oblique groove
28: second front surface oblique groove
29: first front surface contact point
30: second front surface contact point
31: first oblique groove notch
32: second oblique groove notch
33: front surface intersection
34: first front surface recess
35: second front surface recess
36: first reinforcing rib
37: second reinforcing rib
38: back surface arc groove
39: first back surface oblique groove
40: second back surface oblique groove
41: first back surface recess
42: second back surface recess
43: back surface intersection
44: first back surface contact point
45: second back surface contact point
46: body through hole

What is claimed is:

1. A ground terminal to be attached to a body, comprising:
a body fixing portion to be fixed to the body; and
a wire connecting portion rearward of the body fixing portion and to be connected to a wire,
wherein:
the body fixing portion is plate-shaped and includes a through hole through which a fixing member is inserted,
the body fixing portion is formed with an arc groove having an arc shape along a peripheral edge of the through hole, and
the body fixing portion is formed with an oblique groove connected to the arc groove in a tangential manner and extending obliquely rearward with respect to a longitudinal extending direction of the wire connected to the wire connecting portion to a side edge of the body fixing portion and intersecting the longitudinal extending direction of the wire connected to the wire connecting portion.

2. The ground terminal of claim 1, wherein the arc groove is formed in a region of the body fixing portion outside a part where the fixing member and the body fixing portion are in contact, with the body fixing portion fixed to the body by the fixing member.

3. The ground terminal of claim 1, wherein the arc groove is formed between the through hole and the wire connecting portion in the body fixing portion.

4. The ground terminal of claim 1, wherein the oblique groove is formed along a tangent to the arc groove.

5. The ground terminal of claim 4, wherein the body fixing portion is formed with a recess in a part where the arc groove and the oblique groove are connected, the recess having a triangular shape when viewed from a direction intersecting a plate surface of the body fixing portion.

6. The ground terminal of claim 1, wherein the oblique groove extends to a side edge of the body fixing portion.

7. The ground terminal of claim 6, wherein an oblique groove notch cut toward the oblique groove from the side edge of the body fixing portion is formed in a part of the side edge of the body fixing portion where the oblique groove reaches the side edge of the body fixing portion.

8. The ground terminal of claim 1, wherein an arc groove notch cut toward the arc groove is formed at a position corresponding to an end part of the arc groove on a side edge of the body fixing portion.

9. The ground terminal of claim 1, wherein the body fixing portion includes a breaking hole penetrating through the body fixing portion near the arc groove.

10. The ground terminal of claim 9, wherein the arc groove is provided continuously with both ends of the breaking hole.

11. The ground terminal of claim 1, wherein the oblique groove extends at an angle of $\pi/4$ radians or $-\pi/4$ radians with respect to the extending direction of the wire fixed to the wire connecting portion.

12. The ground terminal of claim 1, wherein the body fixing portion is formed with a plurality of the oblique grooves, and the plurality of oblique grooves intersect each other.

13. The ground terminal of claim 1, wherein the arc groove and the oblique groove are formed in both front and back surfaces of the body fixing portion.

14. The ground terminal of claim 13, wherein a back surface oblique groove formed in the back surface of the body fixing portion is formed at a position corresponding to a front surface oblique groove formed in the front surface of the body fixing portion.

15. The ground terminal of claim 1, wherein a reinforcing rib standing up from a plate surface of the body fixing portion is formed on a side edge of the body fixing portion in a region where the arc groove and the oblique groove are formed.

16. The ground terminal of claim 1, wherein a projection extending in a direction intersecting a plate surface of the body fixing portion is formed on a side edge of the body fixing portion, and the projection is inserted into an insertion hole formed in the body.

17. A ground terminal to be attached to a body, comprising:

a body fixing portion to be fixed to the body; and a wire connecting portion to be connected to a wire, wherein:

the body fixing portion is plate-shaped and includes a through hole through which a fixing member is inserted, the body fixing portion is formed with an arc groove having an arc shape along a peripheral edge of the through hole, and the body fixing portion is formed with a plurality of oblique grooves connected to the arc groove in a tangential manner, each of the plurality of oblique grooves extending with respect to a longitudinal extending direction of the wire connected to the wire connecting portion to intersect the longitudinal extending direction of the wire connected to the wire connecting portion and the plurality of oblique grooves intersecting each other.

18. A ground terminal to be attached to a body, comprising:

a body fixing portion to be fixed to the body; and a wire connecting portion to be connected to a wire, wherein:

the body fixing portion is plate-shaped and includes a through hole through which a fixing member is inserted, the body fixing portion is formed with an arc groove having an arc shape along a peripheral edge of the through hole, and the body fixing portion is formed with an oblique groove connected to the arc groove in a tangential manner and extending at an angle of $\pi/4$ radians or $-\pi/4$ radians with respect to a longitudinal extending direction of the wire and intersecting the longitudinal extending direction of the wire.

* * * * *